US010074304B2

(12) United States Patent
Chaji

(10) Patent No.: US 10,074,304 B2
(45) Date of Patent: Sep. 11, 2018

(54) SYSTEMS AND METHODS OF PIXEL CALIBRATION BASED ON IMPROVED REFERENCE VALUES

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 83 days.

(21) Appl. No.: 15/230,397

(22) Filed: Aug. 6, 2016

(65) Prior Publication Data

US 2017/0039939 A1 Feb. 9, 2017

(30) Foreign Application Priority Data

Aug. 7, 2015 (CA) ..... 2900170

(51) Int. Cl.
*G09G 3/3225* (2016.01)

(52) U.S. Cl.
CPC ... *G09G 3/3225* (2013.01); *G09G 2300/0408* (2013.01); *G09G 2320/029* (2013.01); *G09G 2320/045* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |
| 4,090,096 | A | 5/1978 | Nagami |
| 4,160,934 | A | 7/1979 | Kirsch |
| 4,354,162 | A | 10/1982 | Wright |
| 4,943,956 | A | 7/1990 | Nom |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |
| 5,489,918 | A | 2/1996 | Mosier |

(Continued)

FOREIGN PATENT DOCUMENTS

| | | |
|---|---|---|
| CA | 1 294 034 | 1/1992 |
| CA | 2 109 951 | 11/1992 |

(Continued)

OTHER PUBLICATIONS

International Search Report corresponding to PCT Application No. PCT/IB2016/054763, Canadian Intellectual Property Office, dated Nov. 25, 2016; (4 pages).

(Continued)

*Primary Examiner* — Nicholas J Lee
*Assistant Examiner* — Duane N Taylor, Jr.
(74) *Attorney, Agent, or Firm* — Nixon Peabody LLP

(57) ABSTRACT

What is disclosed are systems and methods of compensation of images produced by active matrix light emitting diode device (AMOLED) and other emissive displays. The electrical output of a pixel is compared with a reference value to adjust an input for the pixel. In some embodiments an integrator is used to integrate a pixel current and a reference current using controlled integration times to generate values for comparison.

18 Claims, 3 Drawing Sheets

(56) References Cited

U.S. PATENT DOCUMENTS 5,498,880 A 3/1996 Lee
5,557,342 A 9/1996 Eto
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,392,617 B1 5/2002 Gleason
6,404,139 B1 6/2002 Sasaki et al.
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,542,138 B1 4/2003 Shannon
6,555,420 B1 4/2003 Yamazaki
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih et al.
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,248,236 B2 7/2007 Nathan
7,262,753 B2 8/2007 Tanghe

(56) References Cited

U.S. PATENT DOCUMENTS 7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son et al.
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,339,386 B2 12/2012 Leon
8,441,206 B2 5/2013 Myers
8,493,296 B2 7/2013 Ogawa
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0180369 A1 12/2002 Koyama
2002/0180721 A1 12/2002 Kimura
2002/0181276 A1 12/2002 Yamazaki
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0094930 A1* 5/2003 Pierre ..... G09G 3/22
323/275
2003/0107560 A1 6/2003 Yumoto
2003/0111966 A1 6/2003 Mikami
2003/0122745 A1 7/2003 Miyazawa
2003/0122813 A1 7/2003 Ishizuki
2003/0142088 A1 7/2003 LeChevalier
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0252089 A1 12/2004 Ono
2004/0257313 A1 12/2004 Kawashima
2004/0257353 A1 12/2004 Imamura
2004/0257355 A1 12/2004 Naugler

(56) References Cited

U.S. PATENT DOCUMENTS

2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy et al.
2006/0007249 A1 1/2006 Reddy et al.
2006/0012310 A1 1/2006 Chen
2006/0012311 A1 1/2006 Ogawa
2006/0015272 A1 1/2006 Giraldo et al.
2006/0022305 A1 2/2006 Yamashita
2006/0027807 A1 2/2006 Nathan
2006/0030084 A1 2/2006 Young
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077134 A1 4/2006 Hector et al.
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103611 A1 5/2006 Choi
2006/0125740 A1 6/2006 Shirasaki et al.
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish et al.
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok et al.
2007/0103419 A1 5/2007 Uchino
2007/0115221 A1 5/2007 Buchhauser
2007/0126672 A1 6/2007 Tada et al.
2007/0164664 A1 7/2007 Ludwicki
2007/0164938 A1 7/2007 Shin
2007/0182671 A1 8/2007 Nathan
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0136770 A1 6/2008 Peker et al.
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0231558 A1 9/2008 Naugler
2008/0231562 A1 9/2008 Kwon
2008/0231625 A1 9/2008 Minami
2008/0246713 A1 10/2008 Lee
2008/0252223 A1 10/2008 Toyoda
2008/0252571 A1 10/2008 Hente
2008/0259020 A1 10/2008 Fisekovic
2008/0290805 A1 11/2008 Yamada
2008/0297055 A1 12/2008 Miyake
2009/0033598 A1 2/2009 Suh
2009/0058772 A1 3/2009 Lee
2009/0109142 A1 4/2009 Takahara

(56) References Cited

U.S. PATENT DOCUMENTS

| | | | | |
|---|---|---|---|---|
| 2009/0121994 | A1 | 5/2009 | Miyata | |
| 2009/0146926 | A1 | 6/2009 | Sung | |
| 2009/0160743 | A1 | 6/2009 | Tomida | |
| 2009/0174628 | A1 | 7/2009 | Wang | |
| 2009/0184901 | A1 | 7/2009 | Kwon | |
| 2009/0195483 | A1 | 8/2009 | Naugler, Jr. | |
| 2009/0201281 | A1 | 8/2009 | Routley | |
| 2009/0206764 | A1 | 8/2009 | Schemmann | |
| 2009/0207160 | A1 | 8/2009 | Shirasaki et al. | |
| 2009/0213046 | A1 | 8/2009 | Nam | |
| 2009/0244046 | A1 | 10/2009 | Seto | |
| 2009/0262047 | A1 | 10/2009 | Yamashita | |
| 2010/0004891 | A1 | 1/2010 | Ahlers | |
| 2010/0026725 | A1 | 2/2010 | Smith | |
| 2010/0039422 | A1 | 2/2010 | Seto | |
| 2010/0039458 | A1 | 2/2010 | Nathan | |
| 2010/0045646 | A1 | 2/2010 | Kishi | |
| 2010/0045650 | A1 | 2/2010 | Fish et al. | |
| 2010/0060911 | A1 | 3/2010 | Marcu | |
| 2010/0079419 | A1 | 4/2010 | Shibusawa | |
| 2010/0085282 | A1 | 4/2010 | Yu | |
| 2010/0103160 | A1 | 4/2010 | Jeon | |
| 2010/0134469 | A1 | 6/2010 | Ogura et al. | |
| 2010/0134475 | A1 | 6/2010 | Ogura et al. | |
| 2010/0165002 | A1 | 7/2010 | Ahn | |
| 2010/0194670 | A1 | 8/2010 | Cok | |
| 2010/0207960 | A1 | 8/2010 | Kimpe | |
| 2010/0225630 | A1 | 9/2010 | Levey | |
| 2010/0251295 | A1 | 9/2010 | Amento | |
| 2010/0277400 | A1 | 11/2010 | Jeong | |
| 2010/0315319 | A1 | 12/2010 | Cok | |
| 2011/0050870 | A1 | 3/2011 | Hanari | |
| 2011/0063197 | A1 | 3/2011 | Chung | |
| 2011/0069051 | A1 | 3/2011 | Nakamura | |
| 2011/0069089 | A1 | 3/2011 | Kopf | |
| 2011/0069096 | A1 | 3/2011 | Li | |
| 2011/0074750 | A1 | 3/2011 | Leon | |
| 2011/0074762 | A1 | 3/2011 | Shirasaki et al. | |
| 2011/0149166 | A1 | 6/2011 | Botzas | |
| 2011/0169798 | A1 | 7/2011 | Lee | |
| 2011/0175895 | A1 | 7/2011 | Hayakawa | |
| 2011/0181630 | A1 | 7/2011 | Smith | |
| 2011/0199395 | A1 | 8/2011 | Nathan | |
| 2011/0227964 | A1 | 9/2011 | Chaji | |
| 2011/0242074 | A1 | 10/2011 | Bert et al. | |
| 2011/0273399 | A1 | 11/2011 | Lee | |
| 2011/0292006 | A1 | 12/2011 | Kim | |
| 2011/0293480 | A1 | 12/2011 | Mueller | |
| 2012/0056558 | A1 | 3/2012 | Toshiya | |
| 2012/0062565 | A1 | 3/2012 | Fuchs | |
| 2012/0262184 | A1 | 10/2012 | Shen | |
| 2012/0299970 | A1 | 11/2012 | Bae | |
| 2012/0299973 | A1* | 11/2012 | Jaffari | G09G 3/3208 345/690 |
| 2012/0299978 | A1 | 11/2012 | Chaji | |
| 2013/0027381 | A1 | 1/2013 | Nathan | |
| 2013/0057595 | A1 | 3/2013 | Nathan | |
| 2013/0112960 | A1 | 5/2013 | Chaji | |
| 2013/0135272 | A1 | 5/2013 | Park | |
| 2013/0162617 | A1 | 6/2013 | Yoon | |
| 2013/0201223 | A1 | 8/2013 | Li et al. | |
| 2013/0307834 | A1* | 11/2013 | Chaji | G09G 3/3258 345/211 |
| 2013/0309821 | A1 | 11/2013 | Yoo | |
| 2013/0321671 | A1 | 12/2013 | Cote | |
| 2014/0015824 | A1 | 1/2014 | Chaji et al. | |
| 2014/0022289 | A1 | 1/2014 | Lee et al. | |
| 2014/0043316 | A1 | 2/2014 | Chaji et al. | |
| 2014/0055500 | A1 | 2/2014 | Lai | |
| 2014/0111567 | A1 | 4/2014 | Nathan et al. | |
| 2016/0275860 | A1 | 9/2016 | Wu | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |

(56) References Cited

FOREIGN PATENT DOCUMENTS

WO WO 2012/164474 A2 12/2012
WO WO 2012/164475 A2 12/2012

OTHER PUBLICATIONS

International Written Opinion corresponding to PCT Application No. PCT/IB2016/054763, Canadian Intellectual Property Office, dated Nov. 25, 2016; (9 pages).
Ahnood : "Effect of threshold voltage instability on field effect mobility in thin film transistors deduced from constant current measurements"; dated Aug. 2009.
Alexander : "Pixel circuits and drive schemes for glass and elastic AMOLED displays"; dated Jul. 2005 (9 pages).
Alexander : "Unique Electrical Measurement Technology for Compensation, Inspection, and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-Si:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub-μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degindation"; dated Dec. 2007 (3 pages).
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision, fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009.
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.

(56) References Cited

OTHER PUBLICATIONS

International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, Dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Intellectual Property Office, dated Sep. 11, 2013; (5 pages).
Jafarabadiashtiani : "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee : "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).
Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan : "Backplane Requirements for active Matrix Organic Light Emitting Diode Displays,"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Singh "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler , System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko : "Stability of indium-oxide thin-film transistors by reactive ion beam assisted deposition"; dated 2009.
Wang : "Indium oxides by reactive ion beam assisted evaporation: From material study to device application"; dated Mar. 2009 (6 pages).
Yi He , "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (w/English translation).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).

(56) References Cited

OTHER PUBLICATIONS

Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).
Extended European Search Report for Application No. EP 16157746.5, dated Apr. 8, 2016, (11 pages).

* cited by examiner

SYSTEMS AND METHODS OF PIXEL CALIBRATION BASED ON IMPROVED REFERENCE VALUES

PRIORITY CLAIM

This application claims priority to Canadian Application No. 2,900,170 which was filed Aug. 7, 2015 and which is hereby incorporated by reference in its entirety.

FIELD OF THE INVENTION

The present disclosure relates to image compensation for light emissive visual display technology, and particularly to compensation systems and methods which compare electrical outputs of pixels with expected or reference values in compensating images produced by active matrix light emitting diode device (AMOLED) and other emissive displays.

BRIEF SUMMARY

According to one aspect there is provided a method for compensating an image produced by an emissive display system having pixels, each pixel having a light-emitting device, the method comprising: integrating a pixel current output from the pixel for a pixel integration time generating an integrated pixel current value; comparing the integrated pixel current value with a reference signal, generating at least one comparison value; and adjusting an input for the pixel with use of the comparison value.

In some embodiments, the reference signal is a reference current, and comparing the integrated pixel current value with the reference signal comprises integrating the reference current for a reference integration time generating an integrated reference current value and comparing the integrated reference current value with the integrated pixel current value, generating the at least one comparison value.

In some embodiments, a ratio of the pixel integration time to the reference integration time is controlled with use of an expected ratio of an expected magnitude of the pixel current to a magnitude of the reference current.

In some embodiments, the pixel integration time and the reference integration time comprise non-overlapping time periods. In some embodiments, the pixel integration time and the reference integration time comprise overlapping time periods.

In some embodiments, the reference signal is an analog reference value, and comparing the integrated pixel current value with the reference signal comprises storing the stored analog reference value in a capacitor of at least one integrator and comparing the stored analog reference value with the integrated pixel current value, generating the at least one comparison value.

In some embodiments, storing the analog reference value comprises one of directly charging the capacitor up to the analog reference value and controlling an input of the at least one integrator to charge the capacitor up to the analog reference value. In some embodiments, the analog reference value is controlled with use of an expected magnitude of the pixel output.

According to another aspect there is provided a method for compensating an image produced by an emissive display system having pixels, each pixel having a light-emitting device, the method comprising: sampling a pixel output from the pixel generating a sampled pixel value; integrating a reference current for a reference integration time generating an integrated reference current value; comparing the sampled pixel value with the integrated reference current value, generating at least one comparison value; and adjusting an input for the pixel with use of the comparison value.

In some embodiments, the reference integration time is controlled with use of an expected magnitude of the pixel output.

According to a further aspect there is provided a method for compensating an image produced by an emissive display system having pixels, each pixel having a light-emitting device, the method comprising: sampling a pixel output from the pixel with use of at least one integrator generating a sampled pixel value; comparing the sampled pixel value with a digital reference value, generating at least one comparison value; and adjusting an input for the pixel with use of the comparison value.

According to another further aspect there is provided a system for compensating an image produced by an emissive display system having pixels, each pixel having a light-emitting device, the system comprising: at least one integrator coupled via a pixel switch to a pixel of said emissive display system for measuring an electrical output of the pixel; a comparator digitizer coupled to the at least one integrator for comparing the electrical output of the pixel with a reference signal, generating at least one comparison value; and a data processing unit for adjusting an input for the pixel with use of the comparison value.

Some embodiments further provide for a reference current source coupled via a reference switch to the at least one integrator, in which the reference signal is a reference current produced by the reference current source, the at least one integrator measures the electrical output of the pixel by integrating a pixel current output from the pixel for a pixel integration time generating an integrated pixel current value, the at least one integrator for integrating the reference current for a reference integration time generating an integrated reference current value, and the comparator digitizer compares the electrical output of the pixel with the reference signal by comparing the integrated reference current value with the integrated pixel current value, generating the at least one comparison value.

In some embodiments, the pixel switch is for controlling the pixel integration time and the reference switch is for controlling the reference integration time, a ratio of the pixel integration time to the reference integration time is controlled with use of an expected ratio of an expected magnitude of the pixel current to a magnitude of the reference current.

Some embodiments further provide for a reference current source coupled via a reference switch to the at least one integrator, in which the reference signal is a reference current produced by the reference current source, the at least one integrator measures the electrical output of the pixel by sampling a pixel output from the pixel generating a sampled pixel value, the at least one integrator for integrating the reference current for a reference integration time generating an integrated reference current value, and the comparator digitizer compares the electrical output of the pixel with a reference signal by comparing the integrated reference current value with the sampled pixel value, generating the at least one comparison value.

In some embodiments, the reference switch is for controlling the reference integration time, and the reference integration time is controlled with use of an expected magnitude of the pixel output.

In some embodiments, the reference signal is an analog reference value, the at least one integrator comprises a capacitor, the at least one integrator for storing the analog reference value in said capacitor, the at least one integrator measures the electrical output of the pixel by integrating a pixel current output from the pixel for a pixel integration time generating an integrated pixel current value, and the comparator digitizer compares the electrical output of the pixel with the reference signal by comparing the stored analog reference value with the integrated pixel current value, generating the at least one comparison value.

In some embodiments, the at least one integrator stores the analog reference value in said capacitor by one of directly charging the capacitor up to the analog reference value and having an input of the at least one integrator controlled to charge the capacitor up to the analog reference value. In some embodiments, the analog reference value is controlled with use of an expected magnitude of the pixel output.

In some embodiments, the at least one integrator measures the electrical output of the pixel by sampling a pixel output from the pixel generating a sampled pixel value, the reference signal is a digital reference value, and the comparator digitizer compares the electrical output of the pixel with the reference signal by comparing the digital reference value with the sampled pixel value, generating the at least one comparison value.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
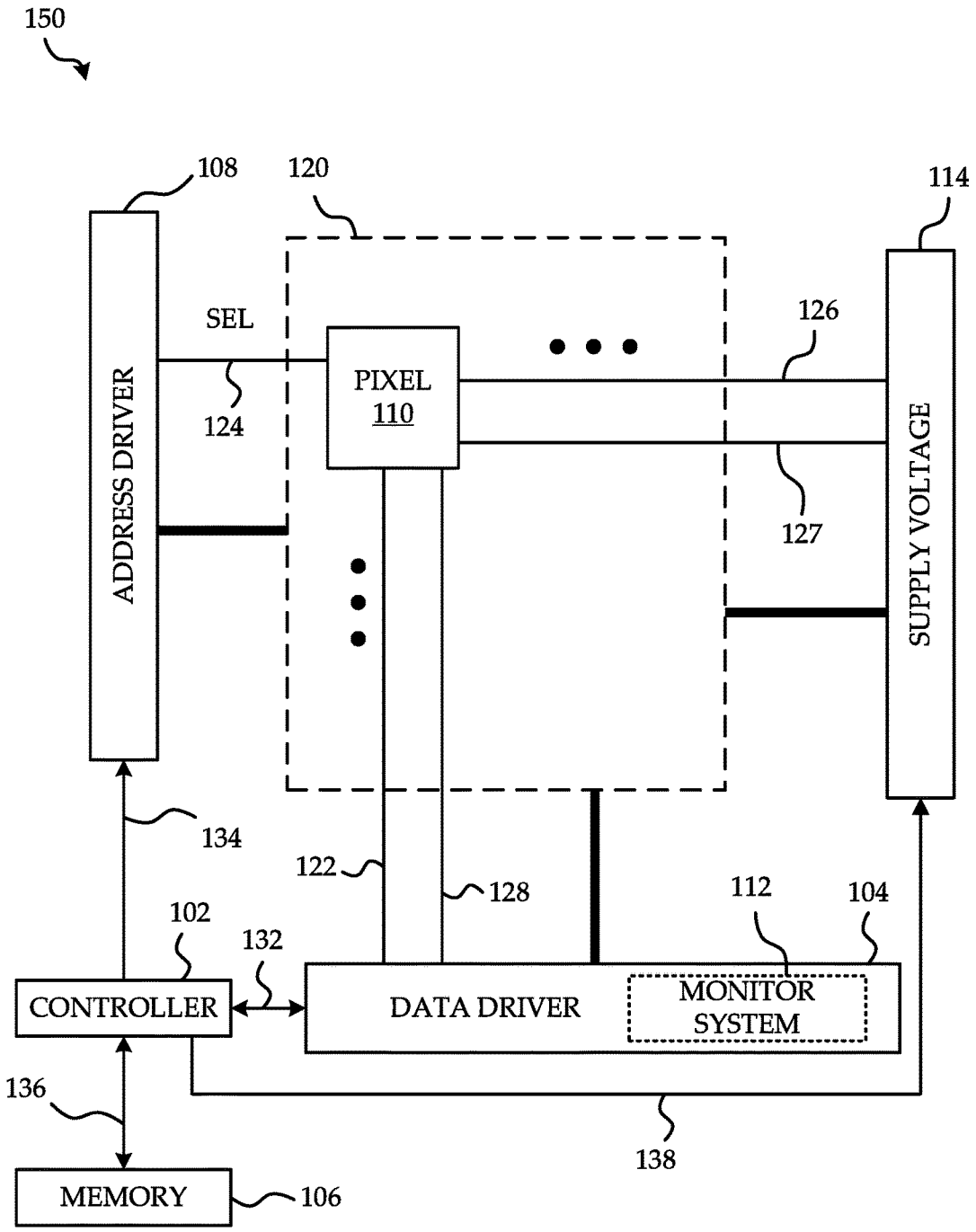
FIG. 1 illustrates an example display system which participates in and whose pixels are to be compensated with use of the compensation systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduces the image represented by the image data.

To avoid error propagation in the calibration of pixels in an array structure of a display, often the best approach is to adjust the input to the pixel to obtain the proper output from the pixel. In one case, a current is the output of the pixel. Here, the current output of the pixel is compared with a reference current corresponding to the proper current and the input to the pixel is adjusted so that the output current is the same as the reference current. One of the challenges in this case is generating accurate reference current at different levels of magnitude. Disclosed herein are systems and methods to reduce the complexity associated with generating low current levels as reference currents and otherwise using measurements of pixel outputs for changing the inputs to the pixels and hence compensating for operating inaccuracies.

While the embodiments described herein will be in the context of AMOLED displays it should be understood that the systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 112 can be integrated with the data driver 104, or can be a separate stand-alone system. In particular, the monitoring system 112 can optionally be implemented by monitoring the current and/or voltage of the data line 122 during a monitoring operation of the pixel 110, and the separate monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110. In another example a pixel current of a pixel 110 may be measured and compared with a proper or expected current in the monitor 112 or another integrated or separate system (not shown) cooperating with the monitor 112, and as a result of that comparison calibration or inputs to the pixel are adjusted to cause it to output the proper expected current. Generally, any data utilized for purposes of calibrating or compensating the display for the above mentioned and similar deficiencies will be referred to herein as measurement data.

Monitoring system 112 may extend to external components (not shown) for measuring characteristics of pixels which are utilized in subsequent compensation, and may include current sources, switches, integrators, comparator/digitizer, and data processing as described below, for directly measuring the output of pixels and comparing it to reference currents or reference data. Generally speaking monitoring system 112 depicted in FIG. 1 along with external modules performs necessary measurements of pixels for use in various compensation methods.

Figure 2A:
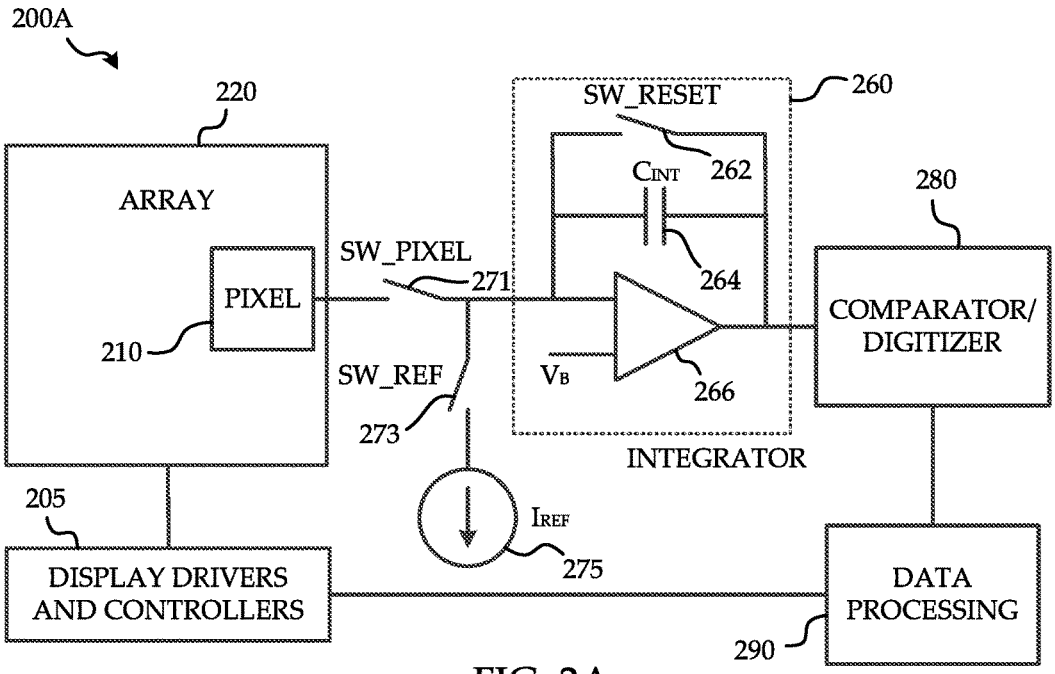
FIG. 2A is a system block diagram of a display system including a charge based comparator for comparing a reference current with current output from a pixel.

Referring to FIG. 2A, part of a display system that participates as a charge based comparator system 200A according to an embodiment which compares a reference current with current output from a pixel 210 will now be described.

The comparator system 200A includes a display array 220 which includes a pixel 210 which for example correspond respectively to the display array panel 120 and pixel 110 of FIG. 1. Coupled to and driving the display array 220 are display drivers and controllers 205 which for example correspond to various drivers and controllers illustrated in FIG. 1 such as the address driver 108, controller 102, memory 106, data driver 104, etc. An output of the pixel 210 is coupled via a pixel switch 271 (SW_PIXEL) to an input of an integrator 260. A reference current source 275 producing a reference current $I_{ref}$ is coupled via a reference switch 273 (SW_REF) to the input of the integrator 260. The integrator 260 includes an amplifier 266 having as its first input the input of the integrator 260 and having $V_B$ as its second input, $V_B$ being set appropriately for integration of the pixel current as discussed below. Connected across and parallel to the first input and an output of the amplifier 266 are a capacitor 264 of capacitance $C_{int}$ and a reset switch 262 (SW_RESET). The output of the amplifier 266 is coupled to the output of the integrator 260 which is coupled to an input of a comparator/digitizer 280, which has an output coupled to a data processing 290 unit. An output of data processing 290 unit is coupled to the display drivers and controllers 205.

The pixel and reference switches 271 273, the current source 275, the integrator 260, the comparator/digitizer 280, and the data processing 290 unit may be implemented in any combination of the controller 102, data driver 104, or monitor 112 of FIG. 1 or may be implemented in separate modules or partly in combination with the controller 102, data driver 104, or monitor 112.

In this method, the pixel current and the reference current are integrated to create two voltages that can be compared and digitalized for making a decision for adjusting the pixel input. Here, the integration time of the reference current $I_{ref}$ can be controlled (by controlling the pixel switch 271 and the reference switch 273) to be shorter than the integration time of the pixel current. As a result to obtain effects in the integrator due to the reference current similar to that produced by the pixel current, the reference current is chosen to be proportionally larger than the pixel current, which proportion is similar to the proportion by which the time of integration for the pixel current is larger than the time of integration for the reference current. For example, if the integration time of the reference current is K times smaller than that of the pixel current, the reference current is set to be K times larger. In a similar manner, in a case of sampling the output charge from the pixel and comparing it with a reference charge created by a reference current, the integration time and magnitude of the reference current can be chosen to match the output charge from the pixel. Given the relatively small currents provided by the pixels, instead of utilizing a relatively inaccurate reference current over a long integration time, the accuracy of the comparison is improved by utilizing a relatively larger reference current exhibiting greater accuracy, over a relatively shorter integration time period.

FIG. 2A illustrates a simplified embodiment of a comparator system 200A capable of performing integration of currents having different integration times for the pixel current and the reference current. It is to be understood that the integration time ratio can be used with other embodiments described herein. Although only one integrator 260 is illustrated as working in concert with switches 271, 273 which can be used to time multiplex the input of the integrator 260 between the reference current and the pixel current, another embodiment utilizes two integrators, each of which produces an input for the comparator/digitizer 280. In either case the comparator/digitizer 280 takes the two input values of integrated current to create a digital output for data processing 290.

After the integration of the reference current and pixel current, the digitizer/comparator 280 creates a digital value that is used by the data processing 290 unit to adjust the input which is to be provided to the pixel by the display drivers and controllers 205. After, the pixel data is finalized, the input data and/or the reference current can be used to calibrate the input of the pixel circuit. This single adjustment to the input to the pixel circuit in many display systems does not guarantee that the pixel 210 will generate the proper expected current but generally will cause the pixel to produce a current which is closer to the proper current than that which was previously produced. In some embodiments, therefore, multiple comparisons of pixel output with reference data will occur prior to all the various the adjustments to the input for the pixel finally arrives at a level which causes the pixel 210 to produce the desired output. The initial and/or this final level of adjustment can be used to update calibration data such as that discussed in association with FIG. 1.

The integration times can be controlled by the pixel switch 271 in series with the pixel 210 and the reference switch 273 in series with the current source 275 and also with use of the reset switch 262. The time that the pixel switch 271 (or reference switch 273) in series with the pixel 210 (or reference current source 275) is ON and the integrator 260 is in integration mode (as controlled by the reset switch 262) defines the integration time of the pixel current (or reference current). When the reset switch 262 is ON, the integrator 260 is not in integration mode. As a result, the overlap of the pixel and reference switches' 271, 273 ON time and the reset switch's 262 OFF time define the integration times. Although the above methods may be utilized with a time-multiplexed scheme, i.e. with the pixel switch 271 and the reference switch 273 being controlled to be ON at different times during integration by the integrator 260, for some embodiments the integration of the pixel current and the reference current may overlap in time.

In another embodiment, the difference between the pixel current and the reference current is integrated to create at least one output voltage. In this case, and as discussed above, the input reference current $I_{ref}$ can be applied to the integrator during a smaller time. To obtain a difference, the sign of the reference current $I_{ref}$ may be arranged to be the opposite of that produced by the pixel. Optionally, when using time multiplexing the comparator 280 could simply subtract one value from another. As a result, the total effect will be $$K_{int}(I_{pixel}*t_{pixel}-I_{ref}*t_{ref}) \quad (1)$$

where '$K_{int}$' is the integrator gain, $I_{pixel}$ is the pixel current, $t_{pixel}$ is the integration time for the pixel current, $I_{ref}$ is the reference current, and $t_{ref}$ is the integration time for the reference current. A similar technique can be used also if the pixel charge (voltage) is being sampled and compared with the reference current. In this case, the output will be $$K_q*Q_{pixel}-K_i*I_{ref}*t_{ref} \quad (2)$$

where $Q_{pixel}$ is pixel charge (or voltage), $K_q$ is the gain of the integrator 260 when used as a sampler for charge, and $K_i$ is the gain of the integrator 260 for current. Based on the result, the input of the pixel is adjusted so as to make the value of either equation become equal to a given value (e.g. zero). Further refinements in the adjustment to the input of the pixel may be made after further measurements and comparisons of current as described are performed.

In the embodiment depicted in FIG. 2A, the pixel current and reference current are applied during the same integration operation to one integrator 260. However, the ON times of the pixel switch 271 and the reference switch 273 defines the integration ratio. For example, during the time the reset switch 262 is OFF and the integrator 260 in integration mode, the ON time of pixel switch 271 in series with pixel 210 and the ON time of the reference switch 273 in series with reference current source 275 define the integration ratio. In another case, where a charge or voltage is sampled from the pixel, the ON time of the reference switch 273 in series with reference current source 275 defines the integration time of the reference current.

In any of the above cases, the integration times for the reference current and/or the pixel current can be adjusted based on expected reference current and pixel current magnitudes. For example, for very small expected reference current, the integration time ratio can be larger so that the actual integrated reference current value is larger while for large reference currents, the integration time ratio can be smaller so that the actual integrated reference current value is not too large. For example, for 1 nA expected reference current, the integration time ratio can be 10 and so the actual measured reference "current" corresponds to 10 nA. In another example, for 1 uA expected reference current, the integration time ratio can be 0.1 or (one). As a result, the actual measured reference "current" will correspond to 100 nA (1 uA). It should be understood that although the integrator in the act of measuring the current integrates a current, the analog form it takes in the capacitor is one of voltage or equally charge, and is dependent both upon the magnitude of the currents and the integration time. It is to be understood, therefore that integrated current values although representing and corresponding to currents are actually voltage or charge stored in the capacitor 264.

Figure 2B:
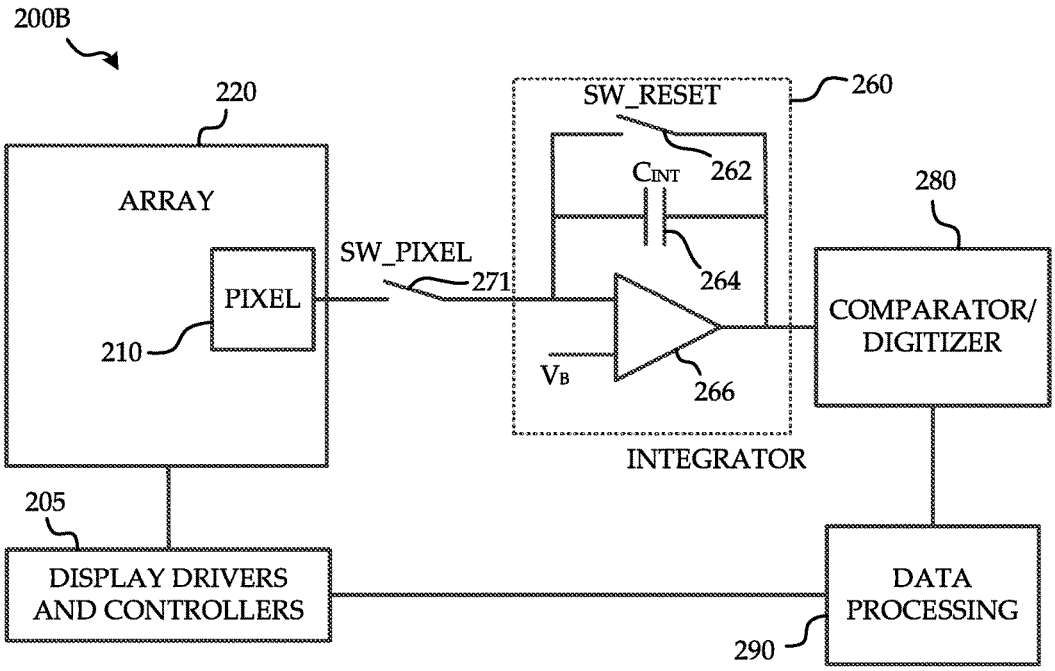
FIG. 2B is a system block diagram of a display system including a charge based comparator for comparing a stored reference charge with a charge integrated from a current output from a pixel.

Referring to FIG. 2B, part of a display system that participates as a charge based comparator system 200B according to one embodiment which compares a stored reference charge with a charge integrated from a current output from a pixel 210 will now be described.

The charge based comparator 200B of FIG. 2B is substantially the same as that described in association with FIG. 2A but differing most notably by not including the reference current source 275 or the reference switch 273. Instead of creating reference voltage (or charge) in a capacitor with a reference current, a predefined voltage (or charge) is used. As was described above, in previous embodiments the effect of a reference current can be calculated as $$V_{ref}=K_{ref}*I_{ref}*t_{ref}. \quad (3)$$

In the embodiment of FIG. 2B, the capacitor 264 of the integrator 260 is directly charged (or set) with the charge (or voltage) corresponding to a reference current as given by equation (3). The resulting charge $Q_{ref}$ is easily determined from $V_{ref}$ and the capacitance $C_{int}$ of the capacitor 264. Alternatively, since there is no reference current source, an estimation of the expected voltage or charge to be measured from the pixel is made. The capacitor 264 is then charged to the voltage or charge expected to be measured from the pixel, optionally of inverse sign to that expected. Then the pixel current (charge or voltage) is actually integrated (or sampled). Here the output will be $$\Delta V=V_{pixel}-V_{ref} \text{ (or } \Delta Q=Q_{pixel}-Q_{ref}) \quad (4)$$

Here, $V_{pixel}$ is either the sampled voltage from the pixel or the result of integrated pixel current (or integrated pixel charge).

For the embodiment illustrated in FIG. 2B, the voltage or charge to be imparted to the capacitor 264 of the integrator 260 can be applied directly. For example, instead of a reset switch 262 (SW_RESET) or connected in parallel to it, the capacitor 264 having capacitance $C_{int}$ is directly charged to a specific voltage or charge defined as outlined above by a charging element (not shown). In another case, $V_B$ can be used to create the voltage or charge value during an integration time. For example, $V_B$ is changed from V1 to V2 during the integration. The change in voltage and the line capacitance creates a charge that will be transferred to capacitor 264 of the integrator 260. The value will be $$Q_{ref}=C_{line}*(V1-V2) \quad (5)$$

where $C_{line}$ is the effective capacitance at input of the integrator 260. Also the effect can be created by an input capacitor that is connected to the input of the integrator, and a step voltage applied to the input capacitor can create a similar reference voltage or charge. In the embodiment depicted in FIG. 2B, the digitizer/comparator 280 creates a digitized value based on the output of the integrator and provides it to the data processing 290 unit. The data processing 290 unit adjusts the input of the pixel according to the digitized value so as to make the output of the integrator (digitizer) become a predefined value (e.g. zero). In this case, the final input and/or the reference value created on the integrator can be used to calibrate the pixel.

Figure 2C:
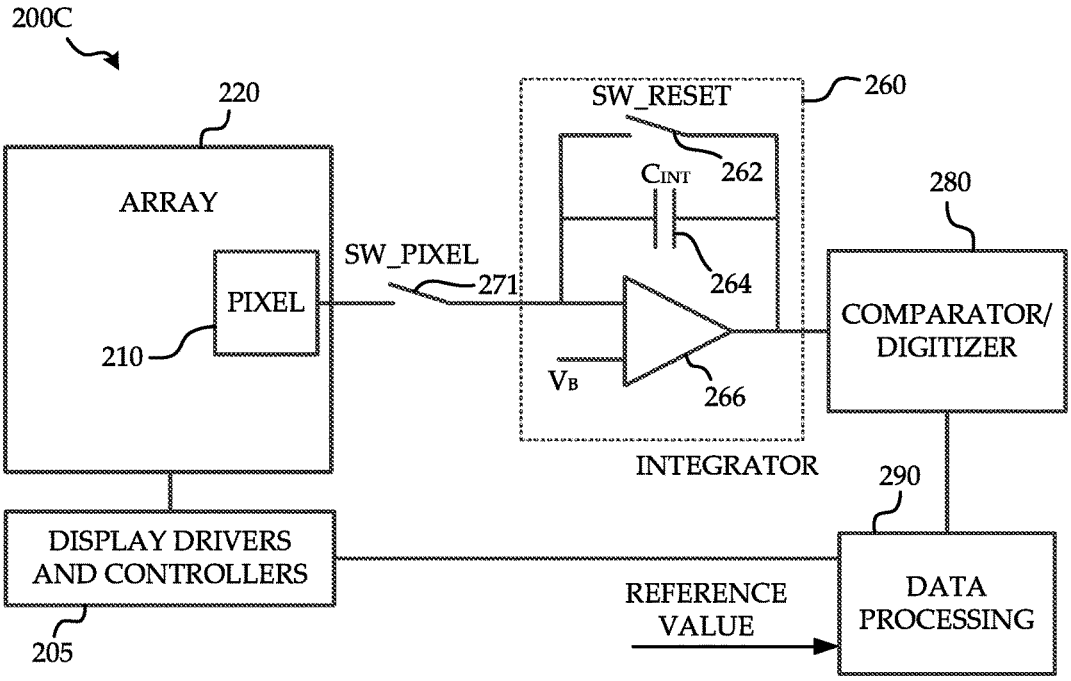
FIG. 2C is a system block diagram of a display system including a charge based comparator for comparing a digital reference value with a value of a charge integrated from a current output from a pixel.

Referring to FIG. 2C, part of a display system that participates as a charge based comparator system 200C according to one embodiment which compares a digital reference value with a value of a charge integrated from a current output from a pixel 210, will now be described.

The charge based comparator 200C of FIG. 2C is substantially the same as that described in association with FIG. 2B but differing most notably by including in data processing by the data processing 290 unit, use of a digital reference value. In the embodiment of FIG. 2C, the pixel output ($V_{pixel}$ or $Q_{pixel}$) is sampled and digitized. The digitized output representing $V_{pixel}$ or $Q_{pixel}$ is compared to a respective reference value, digital $V_{ref}$ or $Q_{ref}$.

In the embodiment illustrated in FIG. 2C, the reference values are generated digitally. The pixel current or charge is integrated (or sampled) by the integrator 260 and digitized by the comparator/digitizer 280. The output of the comparator/digitizer 280 is compared with a given digital reference value by the data processing 290 unit. Based on that comparison, the input of the pixel 210 is adjusted. This process continues till the difference between the reference value and the digitized values of the pixel output is equal to a given threshold (e.g. zero). In this case, the final input of the pixel and/or the reference value is used to calibrate the input of the pixel circuit.

Figure 2D:
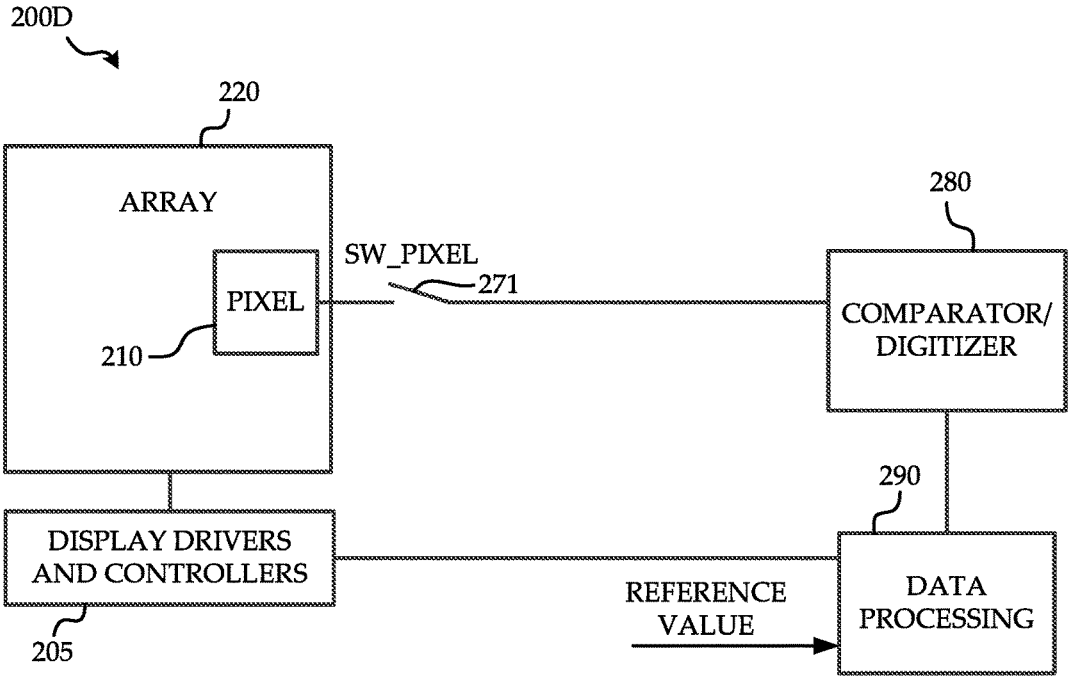
FIG. 2D is a system block diagram of a display system including a comparator for comparing a digital reference value directly with output from a pixel.

Referring to FIG. 2D, part of a display system that participates as a comparator system 200D according to one embodiment which compares a digital reference value directly with output from a pixel 210, will now be described.

The comparator system 200D of FIG. 2D is similar to that described in association with FIG. 2C but differing most notably by not including an integrator 260. In the embodiment of FIG. 2D, the reference values to be compared with the output of the pixel 210 are generated digitally. The pixel's output charge or voltage is sampled and digitized by the comparator/digitizer 280 (or simply a digitizer). The output of the comparator/digitizer 280 is compared by the data processing 290 unit with a given reference value and based on that the input of the pixel is adjusted. This process continues till the pixel difference between reference value and the digitized values is equal to a given threshold (e.g. zero). In this case, the final input of the pixel and/or the reference value is used to calibrate the input of the pixel circuit.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for compensating an image produced by an emissive display system having pixels, each pixel having a light-emitting device, the method comprising:

integrating a pixel current output from the pixel for a pixel integration time generating an integrated pixel current value;

comparing the integrated pixel current value with a reference current including integrating the reference current for a reference integration time generating an integrated reference current value and comparing the integrated reference current value with the integrated pixel current value, generating at least one comparison value; and adjusting an input for the pixel with use of the at least one comparison value.

2. The method of claim 1, wherein a ratio of the pixel integration time to the reference integration time is controlled with use of an expected ratio of an expected magnitude of the pixel current to a magnitude of the reference current.

3. The method of claim 2, wherein the pixel integration time and the reference integration time comprise non-overlapping time periods.

4. The method of claim 2, wherein the pixel integration time and the reference integration time comprise overlapping timeperiods.

5. A method for compensating an image produced by an emissive display system having pixels, each pixel having a light-emitting device, the method comprising:

integrating a pixel current output from the pixel for a pixel integration time generating an integrated pixel current value;

comparing the integrated pixel current value with an analog reference value including storing the stored analog reference value in a capacitor of at least one integrator and comparing the stored analog reference value with the integrated pixel current value, generating at least one comparison value; and adjusting an input for the pixel with use of the at least one comparison value.

6. The method of claim 5, wherein storing the analog reference value comprises one of directly charging the capacitor up to the analog reference value and controlling an input of the at least one integrator to charge the capacitor up to the analog reference value.

7. The method of claim 6, wherein the analog reference value is controlled with use of an expected magnitude of the pixel output.

8. A method for compensating an image produced by an emissive display system having pixels, each pixel having alight-emitting device, the method comprising:

sampling a pixel output from the pixel generating a sampled pixel value;

integrating a reference current for a reference integration time generating an integrated reference current value;

comparing the sampled pixel value with the integrated reference current value, generating at least one comparison value; and adjusting an input for the pixel with use of the comparison value.

9. The method of claim 8, wherein the reference integration time is controlled with use of an expected magnitude of the pixel output.

10. A system for compensating an image produced by an emissive display system having pixels, each pixel having a light-emitting device, the system comprising:

at least one integrator coupled via a pixel switch to a pixel of said emissive display system for measuring an electrical output of the pixel;

a reference current source coupled via a reference switch to the at least one integrator;

a comparator digitizer coupled to the at least one integrator for comparing the electrical output of the pixel with a reference signal, generating at least one comparison value; and a data processing unit for adjusting an input for the pixel with use of the at least one comparison value, wherein the reference signal is a reference current produced by the reference current source, wherein the at least one integrator measures the electrical output of the pixel by integrating a pixel current output from the pixel for a pixel integration time generating an integrated pixel current value, the at least one integrator for integrating the reference current for a reference integration time generating an integrated reference current value, and wherein the comparator digitizer compares the electrical output of the pixel with the reference signal by comparing the integrated reference current value with the integrated pixel current value, generating the at least one comparison value.

11. The system of claim 10, wherein the pixel switch is for controlling the pixel integration time and the reference switch is for controlling the reference integration time, and wherein a ratio of the pixel integration time to the reference integration time is controlled with use of an expected ratio of an expected magnitude of the pixel current to a magnitude of the reference current.

12. The system of claim 11, wherein the pixel integration time and the reference integration time comprise non-overlapping time periods.

13. The system of claim 11, wherein the pixel integration time and the reference integration time comprise overlapping timeperiods.

14. A system for compensating an image produced by an emissive display system having pixels, each pixel having a light-emitting device, the system comprising:

at least one integrator coupled via a pixel switch to a pixel of said emissive display system for measuring an electrical output of the pixel;

a reference current source coupled via a reference switch to the at least one integrator;

a comparator digitizer coupled to the at least one integrator for comparing the electrical output of the pixel with a reference signal, generating at least one comparison value; and a data processing unit for adjusting an input for the pixel with use of the comparison value, wherein the reference signal is a reference current produced by the reference current source, wherein the at least one integrator measures the electrical output of the pixel by sampling a pixel output from the pixel generating a sampled pixel value, the at least one integrator for integrating the reference current for a reference integration time generating an integrated reference current value, and wherein the comparator digitizer compares the electrical output of the pixel with a reference signal by comparing the integrated reference current value with the sampled pixel value, generating the at least one comparison value.

15. The system of claim 14, wherein the reference switch is for controlling the reference integration time, and wherein the reference integration time is controlled with use of an expected magnitude of the pixel output.

16. A system for compensating an image produced by an emissive display system having pixels, each pixel having a light-emitting device, the system comprising:

at least one integrator coupled via a pixel switch to a pixel of said emissive display system for measuring an electrical output of the pixel;

a comparator digitizer coupled to the at least one integrator for comparing the electrical output of the pixel with a reference signal, generating at least one comparison value; and a data processing unit for adjusting an input for the pixel with use of the comparison value, wherein the reference signal is an analog reference value, wherein the at least one integrator comprises a capacitor, the at least one integrator for storing the analog reference value in said capacitor, wherein the at least one integrator measures the electrical output of the pixel by integrating a pixel current output from the pixel for a pixel integration time generating an integrated pixel current value, and wherein the comparator digitizer compares the electrical output of the pixel with the reference signal by comparing the stored analog reference value with the integrated pixel current value, generating the at least one comparison value.

17. The system of claim 16, wherein the at least one integrator stores the analog reference value in said capacitor by one of directly charging the capacitor up to the analog reference value and having an input of the at least one integrator controlled to charge the capacitor up to the analog reference value.

18. The system of claim 17, wherein the analog reference value is controlled with use of an expected magnitude of the pixel output.

* * * * *